US006865911B2

(12) United States Patent
Bolduan et al.

(10) Patent No.: US 6,865,911 B2
(45) Date of Patent: Mar. 15, 2005

(54) HOUSEHOLD MACHINE FOR WASHING OR DRYING LAUNDRY

(75) Inventors: Edwin Bolduan, Berlin (DE); Herbert Kleinlein, Oberasbach (DE); Horst Wiemer, Kleinmachnow (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 0 days.

(21) Appl. No.: 10/609,454

(22) Filed: Jun. 27, 2003

(65) Prior Publication Data

US 2004/0093913 A1 May 20, 2004

Related U.S. Application Data

(63) Continuation of application No. PCT/EP01/14629, filed on Dec. 12, 2001.

(30) Foreign Application Priority Data

Dec. 27, 2000 (DE) ..... 100 65 337

(51) Int. Cl.[7] ..... D06F 39/02
(52) U.S. Cl. ..... 68/17 R; 68/19.2
(58) Field of Search ..... 68/17 R, 12, 18, 68/19.2; 134/57 D, 57 DL, 56 D, 58 D, 58 DL

(56) References Cited

U.S. PATENT DOCUMENTS 5,253,494 A * 10/1993 Frucco et al. ..... 68/12.18
5,687,590 A * 11/1997 Borroni et al. ..... 68/17 R

FOREIGN PATENT DOCUMENTS

DE 31 01 745 A1 8/1982
EP 465800 A1 * 1/1992 ..... D06F/39/02

* cited by examiner

*Primary Examiner*—Frankie L. Stinson
*Assistant Examiner*—Joseph L. Perrin
(74) *Attorney, Agent, or Firm*—Laurence A. Greenberg; Werner H. Stemer; Ralph E. Locher

(57) ABSTRACT

Usually disposed in the top region of a household laundry machine is a drawer that is intended for accommodating detergents or condensate and is connected to a three-dimensional grip plate at the front. During operation of the machine, the grip plate is inserted in a recess of an operating panel, which is disposed at least more or less flush with the surface of the front side of the machine. For childproof locking, a latching edge is provided on the frame of the recess, and a catch, which is retained in the latching position by a spring, is disposed in the rear cavity of the grip plate. By virtue of an arresting device, the catch can be retained outside the latching position if an arresting slide is located in an arresting position.

21 Claims, 4 Drawing Sheets

3
2
4
6
5
1

3
4
7
5

HOUSEHOLD MACHINE FOR WASHING OR DRYING LAUNDRY

CROSS-REFERENCE TO RELATED APPLICATION

This application is a continuation of copending International Application No. PCT/EP01/14629, filed Dec. 12, 2001, which designated the United States and was not published in English.

BACKGROUND OF THE INVENTION

Field of the Invention

The invention relates to a household machine for washing or drying laundry, having a drawer disposed in the top region and being intended for accommodating detergents or condensate, and having a three-dimensional grip plate that is fastened on the front of the drawer and contains a grip hollow on its front side, it being possible to reach, through the grip hollow, a catch that is disposed in the rear cavity of the grip plate, is retained in the latching position by a spring and in the locked position grips, by way of a catch edge, behind a latching edge on the housing.

Such household machines are common and widely available. Attempts have been made to fit locking devices on such machines to avoid unauthorized individuals using the machines at all or, in the case of washing machines, using the drawer of a detergent-dispensing device. The main group of individuals targeted is constituted, in particular, by children, for which reason such devices are generally also referred to as childproof locks.

All previous proposals for such childproof locks, however, are unsatisfactory in some way. For example, German Published, Non-Prosecuted Patent Application DE 31 01 745 A1 discloses a childproof lock of the generic type for a detergent drawer that is unsatisfactory because, on one hand, it is too easy to open and, on the other hand, it is too complicated to deactivate altogether.

SUMMARY OF THE INVENTION

It is accordingly an object of the invention to provide a household machine for washing or drying laundry that overcomes the hereinafore-mentioned disadvantages of the heretofore-known devices of this general type and that configures the lock such that it cannot be opened easily by children but can be deactivated altogether by adults of average intelligence without any complicated manipulations being required.

With the foregoing and other objects in view, there is provided, in accordance with the invention, a household laundry machine for at least one of washing and drying laundry, including a machine housing having a front side having a surface, an operating panel defining a recess with a frame, the operating panel being disposed approximately flush with the surface of the front side, and a latching edge disposed on the frame of the recess and defining a catch edge, and a drawer slidably disposed in the recess for accommodating detergents or condensate therein, the drawer having an insertion direction and a removal direction, a front, a bias device, a three-dimensional grip plate fastened at the front, the grip plate having a front side defining a grip hollow, a latching position, and a rear cavity, a catch disposed in the rear cavity and having an unlocked position and a locked position, the bias device retaining the catch in the locked position, the catch gripping behind the catch edge with respect to the insertion direction in the locked position, an arresting device having an arresting slide moveably disposed into and out from an arresting position, the arresting device retaining the catch out of the locked position when the arresting slide is in the arresting position, during operation of the machine the grip plate being inserted in the recess and the catch interacting with the latching edge to hold the grip plate in the recess, and the grip hollow permitting access by a user for actuating the catch from outside the drawer.

With the objects of the invention in view, in a household laundry machine for at least one of washing and drying laundry, the machine having a housing with a front side having a surface, an operating panel defining a recess with a frame, the operating panel being disposed approximately flush with the surface of the front side, and a latching edge disposed on the frame of the recess and defining a catch edge, there is also provided a detergent holder including a drawer slidably disposed in the recess for accommodating detergents or condensate therein, the drawer having an insertion direction and a removal direction, a front, a bias device, a three-dimensional grip plate fastened at the front, the grip plate having a front side defining a grip hollow, a latching position, and a rear cavity, a catch disposed in the rear cavity and having an unlocked position and a locked position, the bias device retaining the catch in the locked position, the catch adapted to grip behind the catch edge with respect to the insertion direction in the locked position, an arresting device having an arresting slide moveably disposed into and out from an arresting position, the arresting device retaining the catch out of the locked position when the arresting slide is in the arresting position, the grip plate adapted to being inserted in the recess during operation of the machine, the catch adapted to interact with the latching edge to hold the grip plate in the recess, and the grip hollow permitting access by a user for actuating the catch from outside the drawer.

With the objects of the invention in view, there is also provided a household laundry machine for at least one of washing and drying laundry, including a machine housing defining a recess and having a latching edge disposed in the recess, and a drawer slidably disposed in the recess for accommodating detergents or condensate therein, the drawer having a bias device, a three-dimensional grip plate being inserted in the recess during operation of the machine and having a front side defining a grip hollow, a latching position, and a body defining a rear cavity, a catch disposed in the rear cavity and having an unlocked position and a locked position, the bias device retaining the catch in the locked position, the catch gripping the latching edge in the locked position and preventing the drawer from being removed from the recess, the catch interacting with the latching edge to hold the grip plate in the recess when the grip plate is inserted in the recess, an arresting device moveably disposed into and out from an arresting position, the arresting device retaining the catch out of the locked position when the arresting device is in the arresting position, and the grip hollow permitting access by a user for actuating the catch from outside the drawer.

According to the invention, during operation of the machine, the grip plate is inserted in a recess of an operating panel, which is disposed at least more or less flush with the surface of the front side of the machine, and a latching edge that interacts with the catch is provided on the frame of the recess, and the catch can be retained outside the latching position by an arresting device if an arresting slide of the arresting device is located in an arresting position. By virtue of the configuration according to the invention of a plurality of elements that are in functional connection with one another, it is no longer readily possible for children to open a way of blocking access to the detergent drawer. On the other hand, it is possible for operators of average intelligence to deactivate the arresting device altogether without any significant effort and without the aid of tools. Preferably, the bias device is a spring.

In accordance with another feature of the invention, the catch is connected firmly to a handle that projects through to the front side of the grip plate.

In accordance with a further feature of the invention, a handle is firmly connected to the catch and the handle projects away from the catch.

In accordance with an added feature of the invention, the catch has an integral handle projecting away from the catch for providing access by the user to the handle through the grip hollow.

The handle, which is disposed for easy gripping, facilitates the operations both of opening the latching device of the drawer once in each case and of permanently deactivating the arresting device.

In accordance with an additional feature of the invention, in a form of the measure according to the invention that is straightforward to configure in terms of its design, the catch engages, by way of a retaining latching element, in a mating catch on the arresting slide if the catch is located in the non-latching position and the arresting slide is located in the arresting position. The configuration of the childproof lock, thus, manages with a maximum of three additional components—catch, spring, and arresting slide.

In accordance with a concomitant feature of the invention, in which the bias device is a constituent part of the catch, which is of plastic, a part of the catch that is supported on an abutment of the grip plate is configured to be elastic along its length. As such, it is possible to dispense with yet a further component, namely with the spring, which is, then, replaced by that part of the catch that is elastic along its length. It is, then, only necessary to have two additional parts, which are straightforward to configure and to fit, for the purpose of realizing the object.

Other features that are considered as characteristic for the invention are set forth in the appended claims.

Although the invention is illustrated and described herein as embodied in a household machine for washing or drying laundry, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
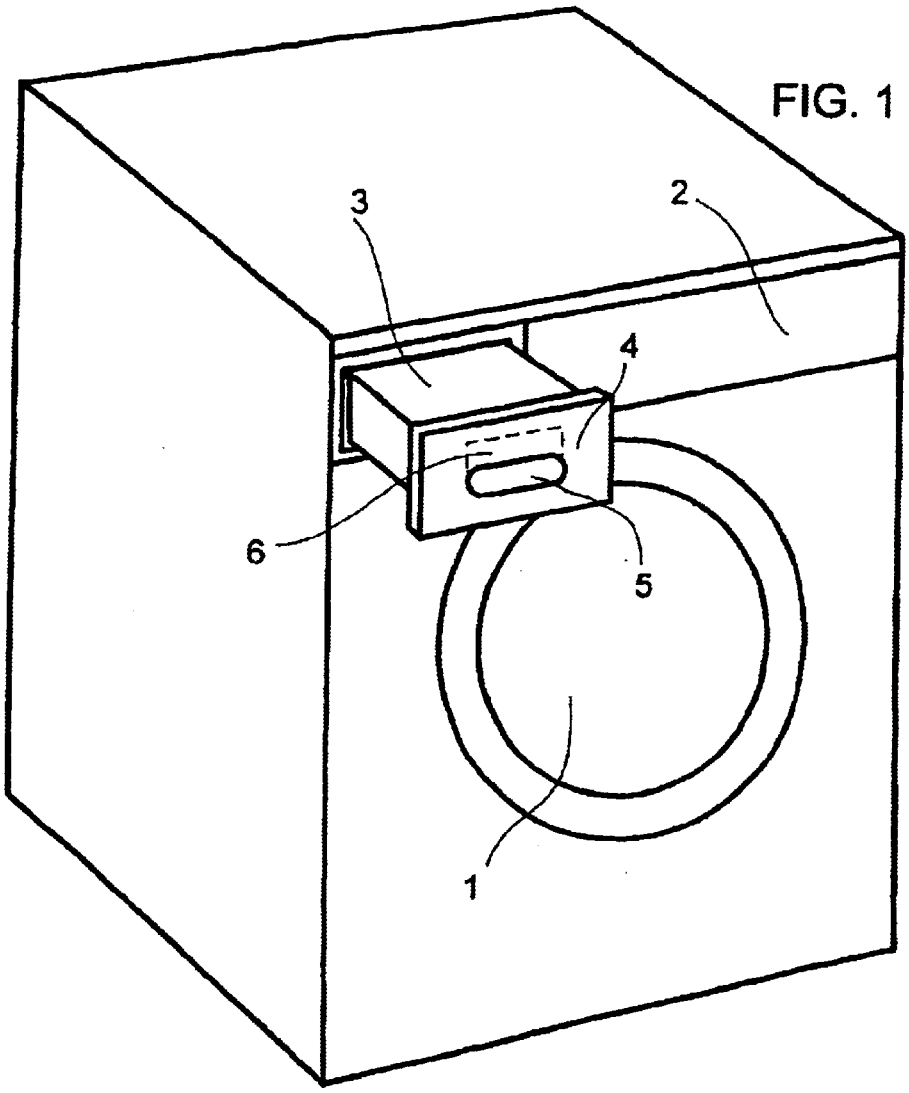
FIG. 1 is a perspective view from the front of a washing machine according to the invention with the detergent drawer in a pulled out position.

Referring now to the figures of the drawings in detail and first, particularly to FIG. 1 thereof, there is shown a washing machine having, above a front filling opening 1, an operating panel 2, alongside which the recess for a detergent drawer 3, only indicated schematically here, is disposed. At the front, the detergent drawer 3 has a screening plate 4, which is usually adapted, in terms of shape and design, to the operating panel 2 and is often also referred to as a grip plate. Provided at an easy-to-grip location of the grip plate 4 is a grip hollow 5, which is set back some way behind the front so that an operator can place his/her fingers therein. Positioned in front of the top region of the grip hollow 5 is a covering plate 6, to allow, finally, the operator's fingers to grip behind the plate 6 in order to pull out the detergent drawer 3 by the grip plate 4 and/or the covering plate 6.

Figure 2:
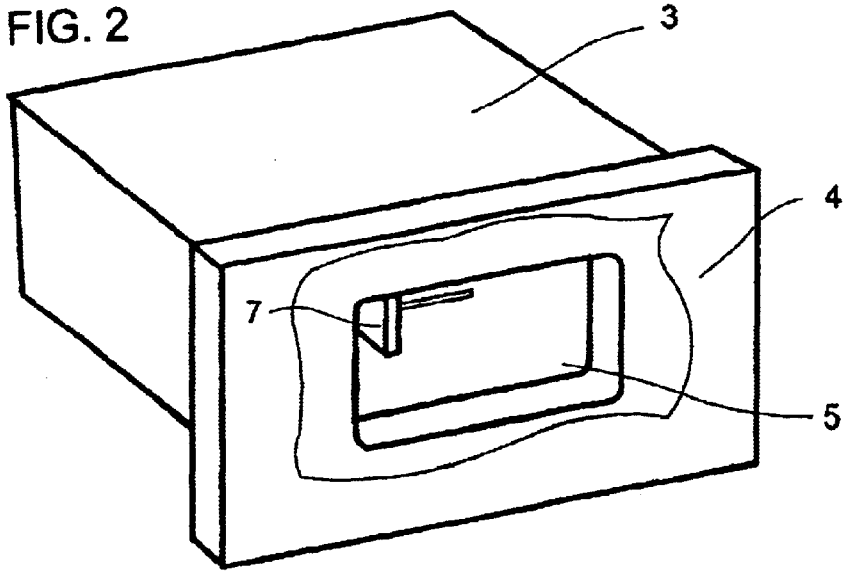
FIG. 2 is a perspective and partially cut-away view from the front of the pulled-out detergent drawer according to the invention with its grip shell freed from the covering plate and the handle being visible.

FIG. 2 shows the detergent drawer 3, once again in a schematic illustration, on an enlarged scale and removed from the recess. Moreover, in such a case, the covering plate has been removed from in front of the grip hollow 5 to make visible a handle 7 that is otherwise concealed behind the covering plate 6 (FIG. 1). The handle 7 can be actuated in a laterally displaceable manner and, in the process, actuate a catch 8 mounted behind the grip plate 4 (FIG. 5), as will be explained in more detail at a later stage in the text. As can be seen from FIG. 5 where the detergent drawer 3 has been completely removed, it is possible for the catch 8 in a right-hand position, with the detergent drawer 3 pushed in to the full extent, to grip behind a latching edge 9 of a latch 14 and, thus, to arrest the detergent drawer 3 in the retracted position. Then, unauthorized individuals cannot access the detergent drawer 3, i.e., the childproof lock is active.

Figure 3:
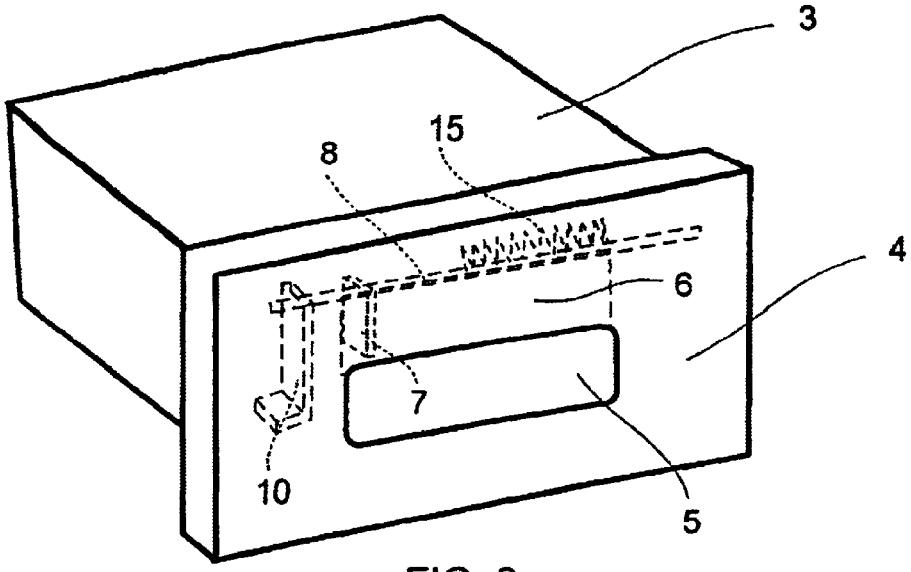
FIG. 3 is a perspective and partially hidden view from the front of the pulled-out detergent drawer of FIG. 2 with the covering plate in front of the grip shell and the catch with handle, the arresting slide and the spring being indicated by dashed lines.
Figure 6:
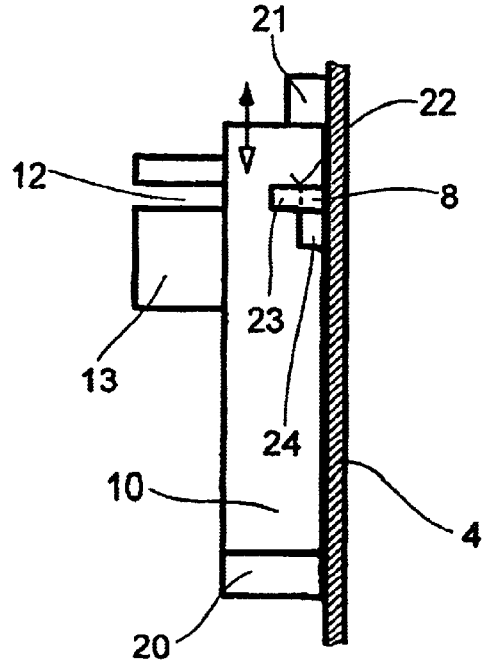
FIG. 6 is an enlarged side elevational view of the arresting slide of FIGS. 2, 3, and 4.

So that the catch 8 can be retained in this or in a non-arresting position, an arresting slide 10 is disposed behind the grip plate 4 (FIG. 3), the function of the arresting slide, together with the rest of the functions of the catch 8 as well, being explained with reference to FIGS. 4 and 6.

Figure 4:
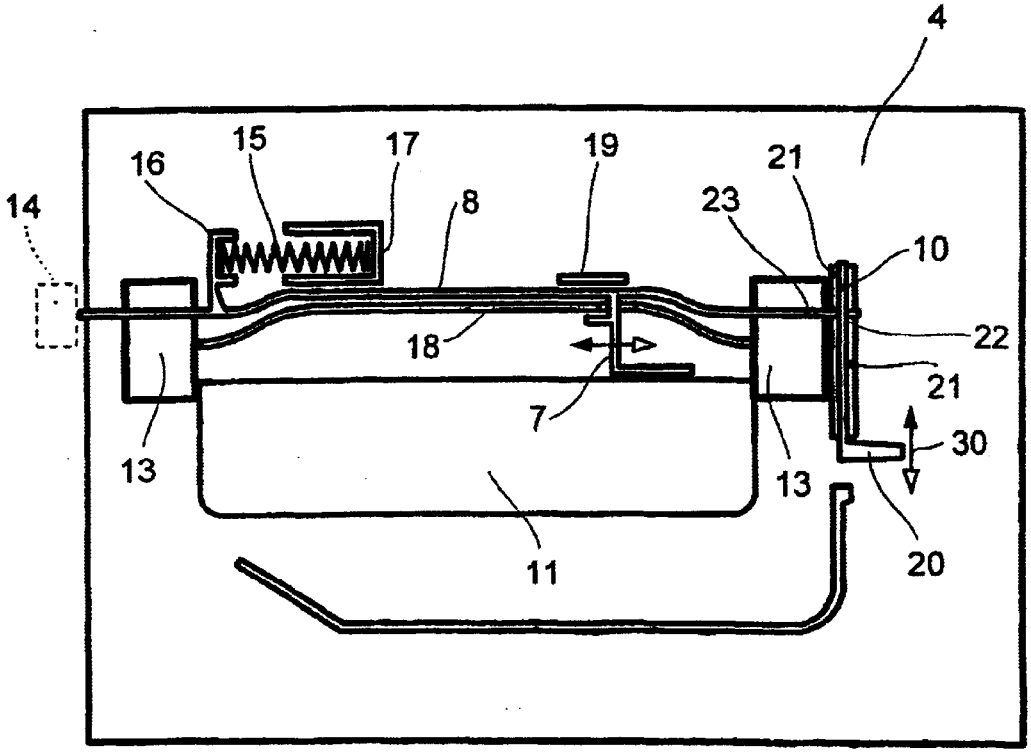
FIG. 4 is an elevational view of the drawer of FIGS. 2 and 3 from the rear with the fitted components.

FIG. 4 shows the grip plate 4 from behind. The grip hollow is formed by a shell 11, which is shown from the rear, is open at the top and above the opening of which the handle 7 for the catch 8 is visible. The catch 8 is mounted on both sides in slot-shaped recesses 12 (FIG. 6) of box-shaped slide guides 13. To improve clarity, a number of components, such as the slide guides 13, have only been depicted in FIGS. 4 and 6 by thick lines, rather than double lines, on account of their thin wall thicknesses. The catch 8 projects out a little way on the side of the border of the grip plate 4 that is on the left in FIG. 4 (on the right-hand side as seen from the front of the drawer). Located on the left of FIG. 4 is a latch 14, disposed in the frame of the recess, with the latching edge 9, behind which the projecting part of the catch 8 can spring when it is pushed in the direction of the latch 14 by the force of the spring 15, which is clamped in between an arm 16 of the catch 8 and an abutment 17 on the grip plate 4.

Over its considerable length, the catch 8 is guided, on one hand, by a top boundary 18 of the grip hollow 5 and, on the other hand, by the abutment 17 and a further guide tab 19 fastened on the grip plate 4. As a result, any transverse forces that may be introduced through the handle 7 cannot bend the catch 8.

To the right of the right-hand slide guide 13 as shown in FIG. 4, the arresting slide 10 is mounted such that it can be displaced in the direction of arrow 30 by its grip tab 20 and is guided longitudinally by bearing parts 21 of the grip plate 4. The arrows on the arresting slide 10 and on the catch 8, depending on whether they have been filled in or not, indicate the direction in which the respective element has to be pushed in order to be moved into the locking or arresting position. A filled-in arrow indicates the locking or arresting position, and an empty or hollow arrow indicates the free position.

At its right-hand end, which passes through a through-passage 22 in the arresting slide 10, the catch 8 has a notch 23, which interacts with a lug 24 in the arresting slide 10 if the catch 8 has been pushed into this position and the lug 24, by virtue of the arresting slide 10 being moved upward, has passed into the notch 23. In such a position, the catch 8 is retained counter to the force of the spring 15 and is, then, no longer able to grip behind the latching edge 9. As a result, the detergent drawer 3 can be pushed freely in and out.

To activate the childproof lock, the arresting slide 10, thus, has to be pulled into the bottom position again, with the result that the lug 24 disengages from the notch 23 of the catch 8 and the catch 8 springs into the locking position again by virtue of its spring 15. In such a case, it projects, by way of its end that is on the left-hand side of FIG. 4, beyond the outer edge of the grip plate 4, is pushed back briefly into the grip plate 4, counter to the spring pressure, by way of a run-on surface on the latch 14 when the detergent drawer 3 is pushed into the recess, and, then, springs behind the latching edge 9 of the latch 14. As a result, the detergent drawer 3 is locked in the closed position.

For the purpose of opening the detergent drawer 3 once in each case, it is sufficient for an individual in the know to unlock the catch 8 from the latching edge 9 promptly before executing the pulling movement. Once the handle 7 is released, the catch 8 immediately springs back again into the spring-actuated locking position and it is automatically locked again when the detergent drawer 3 is next pushed in.

If the childproof locking is to be eliminated again on a permanent basis, then the catch 8 has to be arrested in the unlocked position upon actuation of the handle 7. This takes place by transferring, with the catch 8 secured, the arresting slide 10 into the top, arresting position. As a result, the lug 24 is pushed into the notch 23 of the catch.

When the catch 8 is released, this notch 23, then, secures the catch 8, counter to its spring force, in the permanently unlocked position.

The spring 15 may be configured, as is shown here, as a helical compression spring made of steel. In contrast, it may also be produced as a tension spring and/or from some other material. A possible variant for the spring would include integrally connecting the spring to the plastic catch 8. In such a case, the plastic, in order to be provided with resilient properties at the same location, would be configured in meandering fashion or to be similarly elastic along its length.

Figure 5:
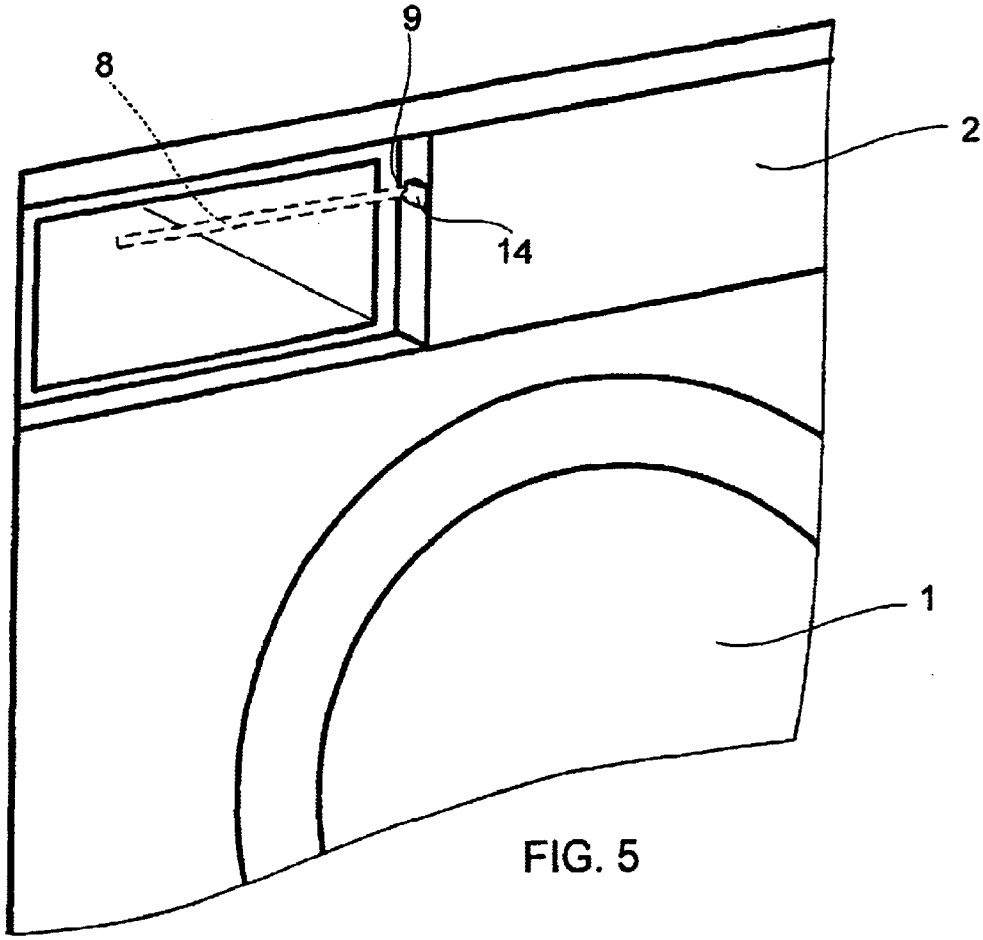
FIG. 5 is a fragmentary, perspective view of the front of the machine according to the invention with the cavity for the detergent drawer having a latching edge on the frame.
Figure 7:
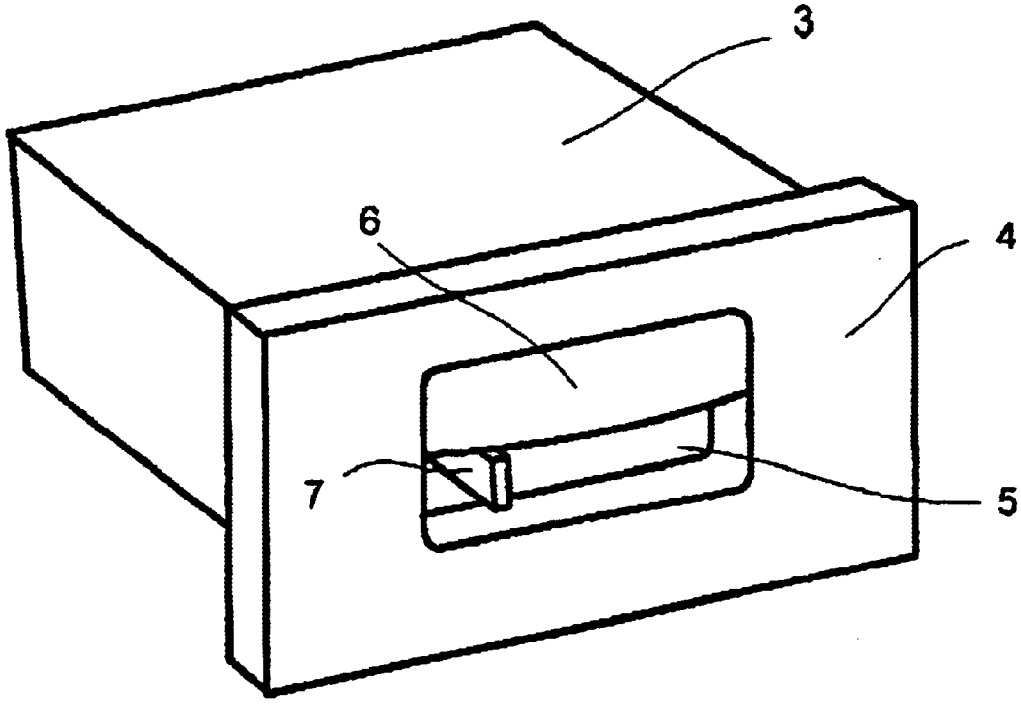
FIG. 7 is a perspective and partially cut-away view from the front of the pulled-out detergent drawer according to the invention with its grip shell freed from the covering plate and the handle projecting through a front side.

FIG. 7 shows the detergent drawer 3, once again in a schematic illustration, on an enlarged scale and removed from the recess. Moreover, in such a case, the covering plate has been removed from in front of the grip hollow 5 to make visible a handle 7 that projects through to the front side of the grip plate. The handle 7 can be actuated in a laterally displaceable manner and, in the process, actuate a catch 8 mounted behind the grip plate 4 (FIG. 5).

The invention has been described above in respect of a detergent drawer for a washing machine. The same motivation for protecting children is also present in the case of condensate vessels that, in a manner similar to a detergent drawer, have a grip plate in the area alongside the operating panel of a laundry dryer. The invention can be used in the same, or a similar, way in this case.

We claim:

1. A household laundry machine for at least one of washing and drying laundry, comprising:

a machine housing having:
- a front side having a surface;
- an operating panel defining a recess with a frame, said operating panel being disposed approximately flush with said surface of said front side; and
- a latching edge disposed on said frame of said recess and defining a catch edge; and a drawer slidably disposed in said recess for accommodating detergents or condensate therein, said drawer having:
- an insertion direction and a removal direction;
- a front;
- a bias device;
- a three-dimensional grip plate fastened at said front, said grip plate having:
  - a front side defining a grip hollow;
  - a latching position; and
  - a rear cavity;
- a catch disposed in said rear cavity and having an unlocked position and a locked position, said bias device retaining said catch in said locked position, said catch gripping behind said catch edge with respect to said insertion direction in said locked position;
- an arresting device having an arresting slide moveably disposed into and out from an arresting position, said arresting device retaining said catch out of said locked position when said arresting slide is in said arresting position;
- during operation of the machine:
  - said grip plate being inserted in said recess; and
  - said catch interacting with said latching edge to hold said grip plate in said recess; and
  - said grip hollow permitting access by a user for actuating said catch from outside said drawer.

2. The machine according to claim 1, wherein said catch has a handle projecting through said grip hollow to said front side of said grip plate.

3. The machine according to claim 1, wherein a handle is firmly connected to said catch and said handle projects away from said catch.

4. The machine according to claim 1, wherein said catch has an integral handle projecting away from said catch for providing access by the user to said handle through said grip hollow.

5. The machine according to claim 1, wherein:

said arresting slide has a mating catch; and said catch has a retaining latching element engaging said mating catch when said catch is in said unlocked position and said arresting slide is in said arresting position.

6. The machine according to claim 1, wherein:

said grip plate has an abutment;

said catch is of plastic;

said bias device is a part of said catch; and a portion of said catch has a length, is supported on said abutment, and is elastic along said length.

7. The machine according to claim 1, wherein said bias device is a spring.

8. In a household laundry machine for at least one of washing and drying laundry, the machine having a housing with a front side having a surface, an operating panel defining a recess with a frame, the operating panel being disposed approximately flush with the surface of the front side, and a latching edge disposed on the frame of the recess and defining a catch edge, a detergent holder comprising:

a drawer slidably disposed in the recess for accommodating detergents or condensate therein, said drawer having:

an insertion direction and a removal direction;

a front;

a bias device;

a three-dimensional grip plate fastened at said front, said grip plate having:

a front side defining a grip hollow;

a latching position; and a rear cavity;

a catch disposed in said rear cavity and having an unlocked position and a locked position, said bias device retaining said catch in said locked position, said catch adapted to grip behind the catch edge with respect to said insertion direction in said locked position;

an arresting device having an arresting slide moveably disposed into and out from an arresting position, said arresting device retaining said catch out of said locked position when said arresting slide is in said arresting position;

said grip plate adapted to being inserted in the recess during operation of the machine;

said catch adapted to interact with the latching edge to hold said grip plate in the recess; and said grip hollow permitting access by a user for actuating said catch from outside said drawer.

9. The machine according to claim 8, wherein said catch has a handle projecting through said grip hollow to said front side of said grip plate.

10. The machine according to claim 8, wherein a handle is firmly connected to said catch and said handle projects away from said catch.

11. The machine according to claim 8, wherein said catch has an integral handle projecting away from said catch for providing access by the user to said handle through said grip hollow.

12. The machine according to claim 8, wherein:

said arresting slide has a mating catch; and said catch has a retaining latching element engaging said mating catch when said catch is in said unlocked position and said arresting slide is in said arresting position.

13. The machine according to claim 8, wherein:

said grip plate has an abutment;

said catch is of plastic;

said bias device is a part of said catch; and a portion of said catch has a length, is supported on said abutment, and is elastic along said length.

14. The machine according to claim 8, wherein said bias device is a spring.

15. A household laundry machine for at least one of washing and drying laundry, comprising:

a machine housing defining a recess and having a latching edge disposed in said recess; and a drawer slidably disposed in said recess for accommodating detergents or condensate therein, said drawer having:

a bias device;

a three-dimensional grip plate being inserted in said recess during operation of the machine and having:

a front side defining a grip hollow;

a latching position; and a body defining a rear cavity;

a catch disposed in said rear cavity and having an unlocked position and a locked position, said bias device retaining said catch in said locked position, said catch gripping said latching edge in said locked position and preventing said drawer from being removed from said recess, said catch interacting with said latching edge to hold said grip plate in said recess when said grip plate is inserted in said recess;

an arresting device moveably disposed into and out from an arresting position, said arresting device retaining said catch out of said locked position when said arresting device is in said arresting position; and said grip hollow permitting access by a user for actuating said catch from outside said drawer.

16. The machine according to claim 15, wherein said catch has a handle projecting through said grip hollow to said front side of said grip plate.

17. The machine according to claim 15, wherein a handle is firmly connected to said catch and said handle projects away from said catch.

18. The machine according to claim 15, wherein said catch has an integral handle projecting away from said catch for providing access by the user to said handle through said grip hollow.

19. The machine according to claim 15, wherein:

said arresting device has a mating catch; and said catch has a retaining latching element engaging said mating catch when said catch is in said unlocked position and said arresting device is in said arresting position.

20. The machine according to claim 15, wherein:

said grip plate has an abutment;

said catch is of plastic;

said bias device is a part of said catch; and a portion of said catch has a length, is supported on said abutment, and is elastic along said length.

21. The machine according to claim 15, wherein said bias device is a spring.

* * * * *